US005693187A

United States Patent [19]

Ampulski et al.

[11] Patent Number: 5,693,187

[45] Date of Patent: Dec. 2, 1997

[54] HIGH ABSORBANCE/LOW REFLECTANCE FELTS WITH A PATTERN LAYER

[75] Inventors: Robert Stanley Ampulski, Fairfield; Ward William Ostendorf, West Chester; Paul Dennis Trokhan, Hamilton, all of Ohio; Henry Louis Marlatt, Tunkhannock, Pa.

[73] Assignee: The Procter & Gamble Company, Cincinnati, Ohio

[21] Appl. No.: 640,452

[22] Filed: Apr. 30, 1996

[51] Int. Cl.[6] ..... D21F 3/00

[52] U.S. Cl. ..... 162/358.2; 162/900; 428/137

[58] Field of Search ..... 428/137, 290; 162/900, 903, 902, 358.2

[56] References Cited

U.S. PATENT DOCUMENTS

| | | | |
|---|---|---|---|
| Re. 32,713 | 7/1988 | Woo | 428/240 |
| 3,549,742 | 12/1970 | Benz | 264/250 |
| 3,836,367 | 9/1974 | Klemm | 96/36.4 |
| 4,250,172 | 2/1981 | Mutzenberg et al. | 428/234 |
| 4,390,574 | 6/1983 | Wood | 428/36 |
| 4,446,187 | 5/1984 | Eklund | 428/136 |
| 4,464,432 | 8/1984 | Dost et al. | 428/280 |
| 4,514,345 | 4/1985 | Johnson et al. | 264/22 |
| 4,528,239 | 7/1985 | Trokhan | 428/247 |
| 4,529,480 | 7/1985 | Trokhan | 162/109 |
| 4,637,859 | 1/1987 | Trokhan | 162/109 |
| 4,795,480 | 1/1989 | Boyer et al. | 51/296 |
| 5,098,522 | 3/1992 | Smurkoski et al. | 162/358 |
| 5,217,799 | 6/1993 | Sumii et al. | 428/280 |
| 5,326,778 | 7/1994 | Landis et al. | 428/282 |
| 5,334,289 | 8/1994 | Trokhan et al. | 162/358.2 |
| 5,346,567 | 9/1994 | Barnewall | 156/78 |
| 5,500,277 | 3/1996 | Trokan et al. | 428/196 |
| 5,514,523 | 5/1996 | Trokan et al. | 430/120 |
| 5,566,724 | 10/1996 | Trokan et al. | 139/383 A |

FOREIGN PATENT DOCUMENTS

| | | |
|---|---|---|
| 0 647 737A1 | 4/1995 | European Pat. Off. . |
| WO 91/14558 | 10/1991 | WIPO . |

*Primary Examiner*—Brenda A. Lamb

*Attorney, Agent, or Firm*—Larry L. Huston; Gerry S. Gressel; E. Kelly Linman

[57] ABSTRACT

An apparatus for making paper. The apparatus comprises a felt and a pattern layer joined to the felt. The felt has a relatively high UV absorbance. Such a high UV absorbance prevents the actinic radiation applied to cure the pattern layer from scattering when the radiation penetrates the surface of the pattern layer. By limiting the scattering of radiation beneath the surface of the pattern layer, extraneous cured pattern layer material is minimized in the regions of the felt where it is desired not to have pattern layer material.

14 Claims, 2 Drawing Sheets

HIGH ABSORBANCE/LOW REFLECTANCE FELTS WITH A PATTERN LAYER

FIELD OF THE INVENTION

The present invention relates to papermaking felts, and more particularly to papermaking felts having a pattern layer for imprinting paper during papermaking.

BACKGROUND OF THE INVENTION

Papermaking felts are well known in the art. Papermaking felts are used to dry paper during the papermaking process. However, conventional papermaking felts produce only single region paper. Single region paper is that paper having only a single density, assuming constant basis weight.

One improvement to conventional felts is the application of a pattern layer to the felt. The pattern layer imprints its pattern into the paper, thereby producing a corresponding high density pattern in the paper. The corresponding high density pattern occurs in the X–Y direction, i.e. within the plane of the paper. Generally, the tensile strength of the paper increases with its density.

Furthermore, patterned paper can be molded into the pattern layer of the felt. Such molding is significant because it increases the caliper of the paper in the Z-direction, i.e. perpendicular to the plane of the paper.

Applying a pattern layer to a papermaking felt is taught in commonly assigned U.S. application Ser. No. 08/461,832 filed Jun. 5, 1995 in the names of Trokhan et al., which application is incorporated herein by reference. The pattern layer is created by applying a liquid precursor, typically a curable resin to the felt. Prior to curing, this liquid precursor permeates the felt. The desired portion of the resin is cured, typically through a patterned mask, to form a solid pattern layer. Any excess liquid resin is removed. Such permeation of the liquid precursor into the felt joins the pattern layer to the felt upon curing.

However, this approach, without more, does not control where the liquid precursor, and hence ultimately after curing, the pattern layer permeates the felt. If too much of the liquid which forms the pattern layer permeates the felt and later cures, the felt becomes impermeable. An impermeable felt is undesirable because it does not allow for water removal from the felt or from the wet web which is in contact with the felt.

A successful attempt to control the disposition of the liquid in the felt is found in commonly assigned U.S. application Ser. No. 08/388,948 filed Feb. 15, 1995 in the names of McFarland et al. and incorporated herein by reference. McFarland et al. controls the depth of permeation of the liquid into the felt by applying a foreign material to the felt which displaces the liquid resin, preventing it from permanently curing in the felt. The foreign material is later washed away.

McFarland et al. controls the Z-direction permeation of the liquid resin which later becomes the pattern layer. McFarland et al. does not, however, prevent curing of the liquid resin into the pattern layer in undesired X–Y positions.

Controlling the curing and disposition of the liquid resin in different X–Y positions is typically accomplished by a mask having regions opaque and transparent to actinic radiation. The liquid registered with the transparent regions is cured and forms the pattern layer. The liquid registered with the opaque regions remains liquid and is later washed away. The use of transparent and opaque masks to selectively cure liquid into a pattern layer is taught in commonly assigned U.S. Pat. No. 4,514,345 issued Apr. 30, 1985 to Johnson et al.; U.S. Pat. No. 4,528,239 issued Jul. 9, 1985 to Trokhan; U.S. Pat No. 4,529,480 issued Jul. 16, 1985 to Trokhan; and U.S. Pat. No. 5,334,289 issued Aug. 2, 1994 to Trokhan, the disclosures of which patents are all incorporated herein by reference.

Actinic curing radiation applied to a papermaking felt scatters within the felt, particularly near the surface. Such scattering cures the liquid resin not only in regions where it is desirable to have the pattern layer, but also in regions where it is desired to wash the liquid away and maintain permeability. Thus, an important aspect of the curing process is preventing uncontrolled scattering of the actinic curing radiation within the felt. Scattering of the radiation is particularly undesirable in the regions where the liquid is to be washed away and the felt remains permeable.

One approach to solving the problem of the felt scattering the curing radiation is to decrease the amount of energy in the curing radiation. Using less energy has successfully been found to prevent undesirable curing in certain regions of the felt.

However, this approach has an undesirable tradeoff. As the curing energy decreases, so does the strength of the resin remaining after the curing operation is completed. Thus, one can either choose to have lower strength resin more accurately disposed in the desired X–Y pattern, or to have stronger resin but with a less accurate X–Y disposition.

Accordingly, it is an object of the present invention to provide a curable pattern layer on a papermaking felt which is not limited by the prior art trade-off. It is further an object of the present invention to control the Z-direction disposition of the pattern layer in the felt.

SUMMARY OF THE INVENTION

Disclosed is an apparatus for removing water from paper during papermaking. The apparatus has an X–Y plane and a Z-direction orthogonal to the X–Y plane. The apparatus comprises a papermaking felt having mutually opposed surfaces, a machine facing surface and a paper facing surface. At least a portion of the felt has a reflectance greater than about 0.4 absorbance units. Preferably such reflectance is a 365 nanometer (nm) reflectance, alternatively, such reflectance may be an average reflectance measured from 301 to 400 nanometers. The apparatus further comprises a pattern layer having mutually opposed surfaces, a felt facing surface and a paper facing surface. The pattern layer is joined to the felt at an interface between the felt facing surface of the pattern layer and the paper facing surface of the felt, and extends outwardly from that interface.

DETAILED DESCRIPTION OF THE INVENTION

Figure 1:
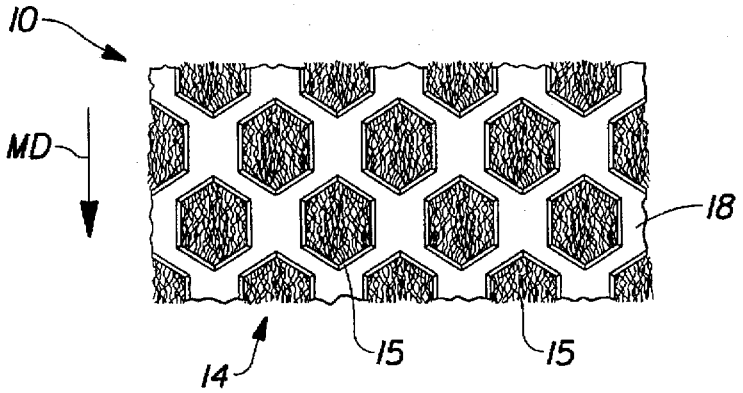
FIG. 1 is a fragmentary top plan view of an apparatus according to the present invention.
Figure 2:
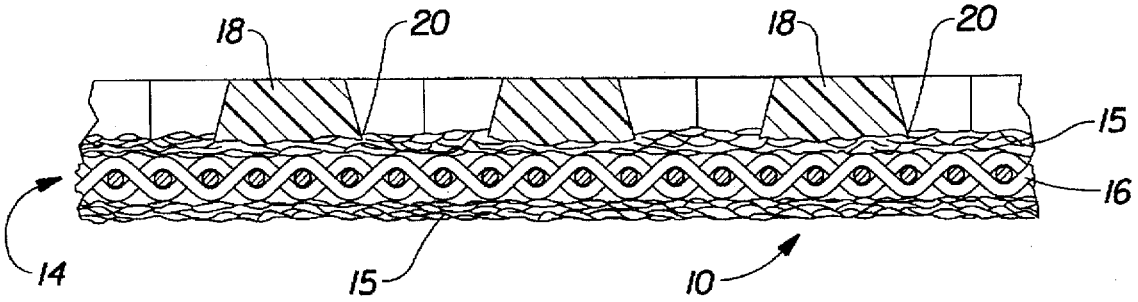
FIG. 2 is a vertical sectional view of the apparatus of FIG. 1.

Referring to FIGS. 1 and 2, the apparatus 10 according to the present invention comprises two principal components, a felt 14 and a pattern layer 18. Each of the felt 14 and the pattern layer 18 have mutually opposed surfaces, and are joined together at an interface 20 between their surfaces. The felt 14 has a paper facing surface and a machine facing surface. The pattern layer 18 has a paper facing surface and a felt facing surface.

The felt 14 and pattern layer 18 are joined together at the interface 20 between paper facing surface of the felt 14 and the felt facing surface of the pattern layer 18. It will be understood from FIG. 2 that the pattern layer 18 may penetrate the paper making surface of the felt 14 and thereby permeate into all of or part of the thickness of the felt 14.

With continuing reference to FIGS. 1 and 2, and examining the felt 14 in more detail, the felt 14 must be able to dewater the paper, and is therefore preferably water permeable. The felt 14 is capable of receiving water imparted by the paper during the papermaking process. The felt 14 is preferably water permeable so that such received water can later be expressed from or otherwise removed from the felt 14. Preferably the water is expressed from or otherwise removed from the machine facing surface of the felt 14.

The felt 14 comprises two components, a batt 16 and a base 15 joined to the base 16. The batt 15 may be made of natural or synthetic fibers joined to the base 16 by any conventional and well known means, such as needle punching. The batt 15 may be formed from fibers having a denier of about 3 to about 30. The batt 15 may be of constant or variable density. If the batt 15 is of variable density, preferably the density gradient increases from the paper facing surface of the felt 14 to the machine facing surface of the felt 14, so that water is drawn away or expressed from the felt 14 as described above. The batt 15 has fibers which may be made of nylon, wool, polyester, or any other suitable material.

The felt 14 may have an air permeability of less than about 400 standard cubic feet per minute per square foot at a differential pressure of 0.5 inches of water. Air permeability may be measured using a Valmet permeability measuring device, Model WIGO TAIFUN, Type 1000, available from the Valmet Corporation of Karlstad, Sweden. In a preferred embodiment, the dewatering felt 14 may have an air permeability between 5 and 200 standard cubic feet per minute.

The dewatering felt 14 may have a water holding capacity of at least about 100 milligrams of water per square centimeter of paper facing surface area. Preferably, the water holding capacity is at least about 150 milligrams per square centimeter of paper facing surface area. The water holding capacity can be measured using a liquid porosimeter, such as a TRI Autoporosimeter available from TRI/Princeton, Inc. of Princeton, N.J. Water holding capacity measurements are made according to the method described by Miller et al. in the article entitled "Liquid Porosimetry: New Methodology and Applications" at pages 163–70 in the Journal of Colloid and Interface Science, 162 (1994), which article is incorporated herein by reference.

It will be recognized by one of ordinary skill that radiation incident to the felt 14 can either be reflected, absorbed, or transmitted through the felt 14. It is generally assumed that little radiation is transmitted through the felt 14. However, the issue is moot as any radiation transmitted through the felt 14 cannot impinge upon the felt 14, and is therefore neither absorbed nor reflected. One of ordinary skill will further recognize that absorbance and reflectance are generally perceived to be inversely related when measured on a common scale.

To reduce undesired scattering of the UV radiation within the felt 14 during application of the pattern layer 18 thereto, the felt 14 has certain physical and optical properties. Particularly, the reflectance of the felt 14 must be low enough that reflection of actinic radiation incident thereto is minimized.

Herein reflectance is measured in percent reflectance or in absorbance units, and plotted in absorbance units in the figures. As used herein, reflectance is found as the $-\text{Log}_{10}\{(\text{I reflected})/(\text{I incident})\}$, wherein I incident is the intensity of the source, and I reflected is the intensity of the reflected signal. It will be understood that less reflectance occurs as the value of the absorbance units increases. It will be understood that the reflectance of a particular material is dependent upon the wavelength of the radiation incident thereto, without regard to whether or not the radiation is in the visible light regime or is invisible to the eye.

At least a portion of the felt 14 has a 365 nm reflectance less than 40% (greater than 0.4 absorbance units), and preferably less than 32% (greater than 0.5 absorbance units), and more preferably less than 25% (greater than 0.6 absorbance units), and most preferably less than 20% (greater than 0.7 absorbance units). The 365 nm reflectance is measured at 365 nanometers.

Preferably the felt 14 also has an average reflectance value greater than 0.4 absorbance units, and preferably greater than 0.5 absorbance units, and more preferably greater than 0.6 absorbance units, and most preferably greater than 0.7 absorbance units. As used herein, the average reflectance value represents the arithmetic average of the 100 reflectance measurements in absorbance units when the sample is measured over the range of 301 to 400 nanometers in one nanometer increments.

The diffuse reflectance value of the felt 14 is measured using a Perkin-Elmer Lambda 9 UV/VIS/NIR Spectrophotometer with a Labsphere DRTA 9A Reflectance/Transmittance accessory or equivalent. The Spectrophotometer is set up in the following manner: diffuse reflectance, Ord (ordinate) to absorbance, Slit to 2 nanometers, Speed to 120 nm per minute, Response to Integration to 1 second, NCYCL (number of cycles) to 1, Scan Range to 250–400 nm. At least the paper facing surface of the felt 14 is sampled, although both surfaces of the felt 14 may be sampled, if desired. The absorbance value was obtained at 365 nm and an average absorbance value was obtained over the range of 301 to 400 nm.

Figure 3:
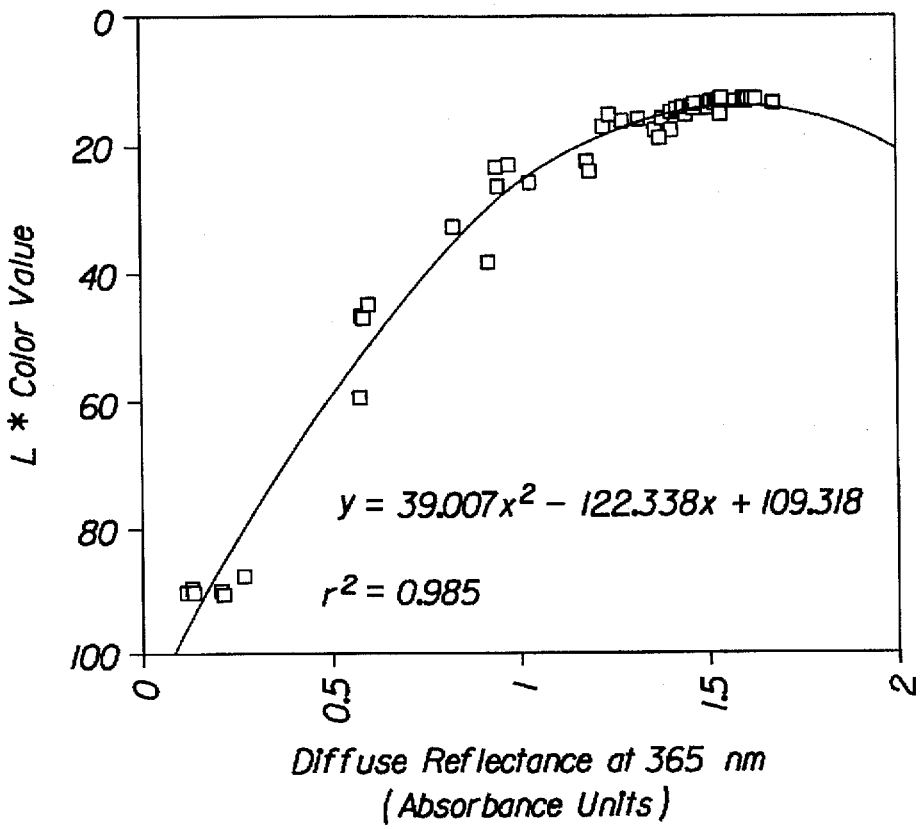
FIG. 3 is a graphical representation of the relationship between L* color value and diffuse reflectance at 365 nm.

One manner in which the desired 365 nm and average reflectance values can be obtained is by providing a particular L* color value to the felt 14. As illustrated in FIG. 3, there is an inverse relationship between L* color value and 365 nm reflectance (throughout most of the range) for at least one particular dye, as discussed below.

Accordingly, at least a portion of the felt 14 may have an L* color value less than 50, preferably less than L*40, and more preferably less than L*35 and meet the specified reflectance. It is further preferred that the opacity of the felt 14 not be too great. If the opacity is too great, the pattern layer 18 will not be adequately joined to the felt 14 and may separate therefrom during use.

The L* color value of the felt 14 is determined using a colorimeter. While many suitable colorimeters are well known in the art, a suitable colorimeter is available from Hunter Associates Laboratory of Reston, Va. as a ColorQUEST 45/0 System consisting of a DP-9000 Processor and a standard 45/0 optical sensor. The 2° standard observer and C illuminant are selected. The L* color value is measured using the L*a*b* color scale. Using this scale, an L* value of 100 represents white, and an L* value of 0 represents black. The a* value indicates redness when positive or greenness when negative. The b* value indicates yellowness when positive or blueness when negative.

The aforementioned 365 nm reflectance, average reflectance, and L* color values may be achieved by dying the felt 14, so that when actinic curing radiation is applied to the felt 14, radiation which penetrates the paper facing surface of the felt 14 is absorbed, rather than scattered. Of course, it would be acceptable for the radiation to transmit directly through the felt 14, from the paper facing surface to the machine facing surface. However, most felts are too high in density and basis weights for such transmission to occur. Therefore, it is usually necessary to decrease reflectance of the felt 14 by increasing its absorbance.

The papermaking felt 14 may be dyed generally in accordance with the instructions provided with the dye for the felt 14. Suitable dyes for dying the felt 14 include water soluble dyes. Particularly suitable dyes are available from CPC Specialty Products, Inc. of Indianapolis, Ind., under the tradename RIT dye.

Although the following example is directed to a felt 14 dyed to have the claimed reflectance, one of ordinary skill will recognize the felt 14 need not be so dyed or treated. So long as the felt 14 has a strong absorbance, and low reflectance to the actinic radiation which cures the pattern layer 18, the felt 14 will be suitable.

EXAMPLE I

A pilot machine belt was made in the following manner. An Amflex 2 Model Press Felt was obtained from Appleton Mills of Appleton, Wis. Thirty gallons of water heated to 210° F. was added to a dye tub. The dye tub was large enough to contain the felt 14 and allow it to be submerged in the water. Fifty-six ounces of RIT black number 15 liquid dye, available from CPC Specialty Products, Inc. of Indianapolis, Ind., was added to the water and thoroughly mixed, to yield a concentration of eight ounces of dye per 3.75 gallons of water. The water was allowed to cool to 185° F. and the felt 14 was immersed in the tub for five minutes, further cooling the water/dye mixture to approximately 175° F.

The felt 14 was then slowly removed from the dye tub and liquid from the dye tub poured over the portion of the felt 14 which was removed therefrom to ensure all portions of the felt 14 were dyed.

After the felt 14 was removed from the tub, the dye solution was emptied and the tank filled with water at room temperature. The dye felt 14 was then quickly rinsed in the dye tub. The felt 14 was removed from the dye tub and excess water allowed to drain therefrom. The felt 14 was then air dried for at least 24 hours at room temperature. Each of the foregoing steps were repeated a second time. The dyed felt 14 was then ready to have the pattern layer 18 added thereto.

Figure 4:
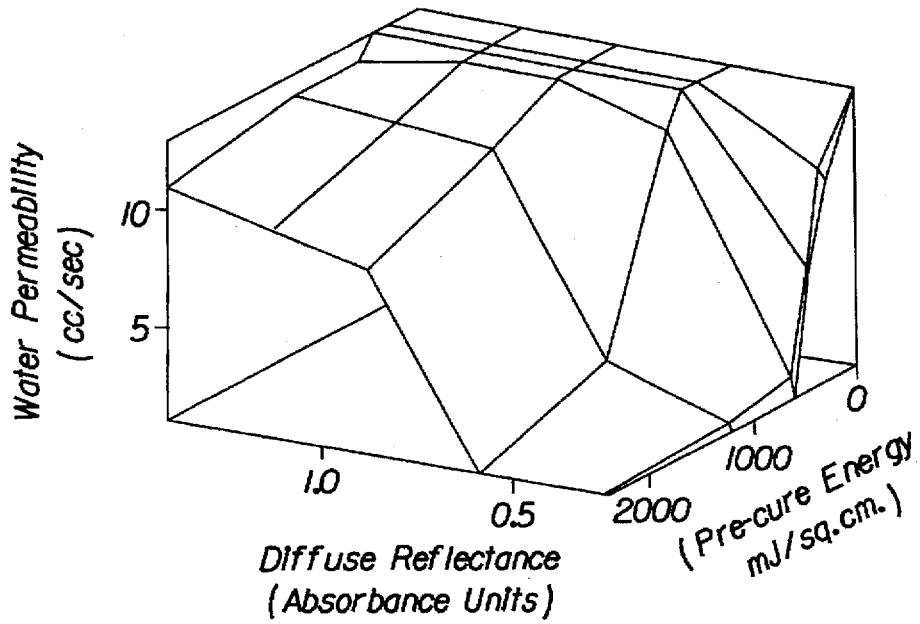
FIG. 4 is a three-dimensional graphical representation of the effect of reflectance and curing energy on the water permeability of the apparatus.

Referring to FIG. 4, at 365 nanometers this exemplary undyed felt 14 had a 365 nm reflectance of approximately 0.2 absorbance units. The felt 14 dyed to a color value of about L* 30 shows a 365 nm reflectance greater than approximately 0.9 absorbance units, while the felt 14 dyed in Example I shows a 365 nm reflectance greater than 1.6 absorbance units. It will be recognized that as the L* color value (and hence the absorbance) increases, the energy reflected at 365 nanometers decreases.

Alternatively, rather than dying the felt 14 as an assembly, the fibers which form the batt 15 of the felt 14 may be dyed prior to needling and being made into the felt 14. Similarly, the base 16 of the felt 14 may be dyed prior to being incorporated into the felt 14.

In an alternative embodiment, the entire felt 14 need not have the specified 365 nm reflectance, average reflectance and L* color value. Only a portion of the felt 14 need have the aforementioned 365 nm reflectance, average reflectance and L* color value. If only a portion of the felt 14 has the aforementioned 365 nm reflectance, average reflectance and L* color value, preferably it is that portion of the felt 14 which is juxtaposed with, and more preferably, includes, the paper facing surface of the felt 14.

In yet another embodiment, the surface of the felt 14 which faces the pattern layer 18 may have a 365 nm reflectance less than about 0.4 absorbance units. The felt 14 may have a region below the surface region which provides the specified 365 nm reflectance of at least about 0.4 absorbance units. Below that level, the felt 14 may again be clear. As used herein, it is understood that a felt which is clear may be white or white colored, so long as the aforementioned 365 nm reflectance values are not provided. It is to be recognized that the machine facing surface of the felt 14 may either be clear or have the aforementioned 365 nm reflectance value. Prophetically this embodiment would improve the durability of the belt.

A typical felt 14 is made of a batt 15 of fibers joined to a base 16 by needle punching, etc. The partially dyed arrangement may be achieved by dying the batt 15 which makes up the felt 14. Alternatively, or preferably in addition to dying the batt 15, the base 16 which forms the felt 14 may also be dyed to the specified 365 nm reflectance, average reflectance and L* color value. The preference for the batt 15 to be of the specified 365 nm reflectance, average reflectance and L* color value is because the pattern layer 18 is most typically joined to the batt 15, rather than to the base 16.

If desired, the batt 15 of the felt 14 may be comprised of both fibers having the specified 365 nm reflectance and fibers which do not meet the specified 365 nm reflectance. This arrangement meets the dual objectives of providing both high resolution of the pattern framework 18 which penetrates the interface of the felt 14 to reside below the pattern layer facing surface of the felt 14, while minimizing the loss of permeability of the felt 14.

Prophetically, the felt 14 may also have an 365 nm reflectance, average reflectance and L* color value which varies according to a pattern disposed in the X–Y plane. If the 365 nm reflectance, average reflectance and L* color value of the felt 14 varies according to an X–Y pattern, preferably the opaque portions of the felt 14 are disposed in an X–Y pattern registered with the portions of the pattern layer 18, discussed below, which does not imprint the paper during the papermaking process.

The pattern layer 18 may be applied to the felt 14 in liquid form, and preferably comprises a resin. The resin is preferably photosensitive, and cures when exposed to actinic radiation. The actinic radiation may have a wavelength of approximately 365 nanometers. Curing is then effected by crosslinking. Suitable resins are disclosed in the previously incorporated U.S. Pat. No. 4,514,345 issued to Johnson, and are available from McDermid, Inc. of Wilmington, Del. as part of the Merigraph series of resins. The resin, when cured into the pattern layer 18, should have a shore D durometer hardness of not more than about 60, as measured upon a resin coupon of about 1 inch×2 inches×0.25 inches thick at 85° C. The reading is taken ten seconds after initial engagement of the durometer probe with the resin.

The liquid which later forms the pattern layer 18 may have a viscosity of about 5,000 to 15,000 centipoises at 70°

F. in order to properly permeate the felt 14 prior to curing. The liquid, preferably a liquid resin, is applied to the felt 14 as follows. The felt 14 may be provided in the form of a continuous belt. The felt 14 is conveyed past a nozzle positioned against the paper facing surface of the felt 14. The nozzle extrudes a film of the liquid, preferably liquid resin, uniformly over the paper facing surface of the felt 14.

The thickness of the liquid coating may be mechanically controlled using a nip. For the embodiments described herein, a suitable coating has a thickness measured from the paper facing surface of the felt 14 to the outward most extending portion of the resin of up to about 2.5 millimeters. A mask having opaque and transparent portions disposed in any desired pattern is placed over the liquid coating on the felt 14. Suitable well known patterns include discrete opaque regions and a transparent region comprising an essentially continuous network, although any desired pattern can be utilized, so long as it occurs in the X–Y plane.

The liquid which later forms the pattern layer 18 is exposed to actinic radiation of an activating wavelength. The actinic radiation is applied through the mask, so that the mask is interposed between the source of the actinic radiation and the liquid coating on the felt 14. The actinic radiation may be supplied from a lamp. This partially cures, or pre-cures, that resin registered with the transparent portions of the mask. The resin registered with the opaque portions of the mask will remain uncured.

Preferably, at least about 300 millijoules per square centimeter of precuring energy is applied to the felt 14 using the actinic radiation. More preferably, at least about 1,200 millijoules per square centimeter of precuring energy is applied to the felt 14 through the transparent portions of the mask. Pre-curing energy may be measured with an ultraviolet energy intensity measuring device, model IL 390-B Light Bug, available from International Light, Inc. of Newburyport, Miss.

Next the uncured liquid resin is removed from the felt 14. The resin is removed by washing the felt 14 layer with a mixture of surfactant, such as Top Job brand detergent manufactured by The Procter & Gamble Company of Cincinnati, Ohio, and water. The surfactant and water may be sprayed onto the felt 14 from showers. The washing may be done at a temperature of about 90° using fan jet nozzles having an orifice diameter of about 0.062 inches, an incident angle of 30°, and a 500 psi delivery pressure. A second wash may be done at a temperature of about 160° using fan jet nozzles having an orifice diameter of about 0.062 inches, an incident angle of 30°, and a 140 psi delivery pressure, all other parameters remaining constant.

The felt 14 and remaining resin, which now has formed a pattern layer 18, travel over or are otherwise juxtaposed with a vacuum shoe. Vacuum is applied to the machine facing side of the felt 14 to remove any uncured liquid remaining in the felt 14. The washing and vacuuming sequence can be repeated as desired. Once the uncured liquid has been removed from the felt 14, the felt 14 is again rinsed to remove any surfactant from the felt 14.

The partially cured resin is then submerged in a water bath and curing actinic radiation is again applied. The water in the bath permits transmission of the actinic radiation from the source to the pattern layer 18, while precluding free oxygen from reaching the pattern layer 18. Free oxygen can quench the polymerization reaction desired to achieve full curing of the pattern layer 18. Preferably the bath does not include surfactant, so that actinic radiation is not attenuated prior to reaching the pattern layer 18. Preferably the bath contains a strong reducing agent, such as sodium sulfite, to scavenge trace amounts of oxygen from the bath.

The cured pattern layer 18 may have an essentially continuous network with discrete openings disposed within the essentially continuous network, as disclosed in commonly assigned '345 patent issued to Johnson et al. Alternatively, the discrete patterns disclosed in Johnson et al. '345 may be utilized.

The pattern layer 18 extends outwardly from a proximal end joined to the felt 14 at the interface 20 to a distal end. The distal end of the pattern layer 18 imprints the paper during papermaking, causing densification of the imprinted areas, and thereby forming multi-region paper. Thus, by extending outwardly from the interface 20 and the felt 14, the pattern layer 18 can form differential density paper during papermaking.

Preferably the pattern layer 18 permeates the felt 14 to a depth of about 0.1 to about 0.5 millimeters, as measured from the paper facing surface of the felt 14 towards the machine facing surface of the felt 14. If the penetration of the pattern layer 18 past the paper facing surface of the felt 14 is less than this amount, the pattern layer 18 may not be adequately joined to the felt 14 and separation during use may occur. Alternatively, if the pattern layer 18 permeates the felt 14 to too great a depth, permeability may be sacrificed.

An exemplary non-limiting example of an apparatus 10 made according to the present invention is contrasted with a prior art apparatus 10. Both apparatuses 10 utilized a pattern layer 18 comprising an essentially continuous network having a surface area about 35 percent of that of the paper facing surface of the felt 14. The pattern layer 18 extended outwardly from the paper facing surface of the felt 14 about 0.25 millimeters. The 365 nm reflectance values of the felt 14, the curing energies applied to the felt 14 and water permeability are shown in Table I below. A gelatinous coating of a gel of a sodium salt of a fatty acid was uniformly applied throughout the felt 14. The resin facing surface of the felt 14 was lightly showered to provide a suitable interface for the pattern layer 18. The rest of this coating was washed away after the pattern layer 18 was precured.

TABLE I

| | Reflectance (Absorbance Units) | Reflectance (percent) | Pre-curing Energy (mJ per square centimeter) | Water Permeability (cc/sec) | Durability (qualitative) |
|---|---|---|---|---|---|
| Prior Art 1 | 0.2 | 63 | 300 | 9 | Unacceptable |
| Present Invention 1 | 1.4 | 4 | 300 | 13 | Unacceptable |
| Prior Art 2 | 0.2 | 63 | 1200 | 1.3 | Acceptable |
| Present Invention 2 | 1.4 | 4 | 1200 | 12.9 | Acceptable |

As can be seen from Table I, the apparatus 10 according to the present invention exhibited significantly improved permeability over the prior art. It is to be recognized that a felt 14 having a minimum permeability of at least 6 cubic centimeters/second and preferably at least 9 cubic centimeters/second is desired in papermaking.

Furthermore, the apparatus 10 according to the present invention receiving the 1200 mJ per sq. centimeter precuring energy not only had acceptable permeability, but also demonstrated acceptable belt durability. If belt durability is unacceptable, an excessive number of belt change-outs will be required.

The scope of the present invention is not limited to this example, but is found in the appended claims.

What is claimed:

1. An apparatus for removing water from paper during papermaking, said apparatus having an X-Y plane and a Z-direction orthogonal thereto, said apparatus comprising:

a papermaking felt layer having mutually opposed surfaces, a machine facing surface and a paper facing surface, at least a portion of said felt having a 365 nm reflectance greater than about 0.4 absorbance units; and a pattern layer comprising a photosensitive resin and having mutually opposed surfaces, a felt facing surface and a paper facing surface, said pattern layer being joined to said felt at an interface between said felt facing surface of said pattern layer and said paper facing surface of said felt, said pattern layer extending outwardly from said felt.

2. An apparatus according to claim 1 wherein said portion of said felt having said 365 nm reflectance greater than about 0.4 absorbance units is juxtaposed with said paper facing surface of said felt.

3. An apparatus according to claim 2 wherein said portion of said felt having said 365 nm reflectance greater than about 0.4 absorbance units extends from said paper facing surface of said felt to said machine facing surface of said felt.

4. An apparatus according to claim 1 wherein said pattern layer comprises an X–Y pattern of two regions, first regions which imprint said paper and second regions which do not imprint said paper.

5. An apparatus according to claim 4 wherein said portions of said felt having said 365 nm reflectance greater than about 0.4 absorbance units are disposed in an X–Y pattern, said X–Y pattern of said portions having said reflectance greater than 0.4 absorbance units being registered with said portions of said pattern layer which do not imprint said paper.

6. An apparatus according to claim 1 wherein said felt has a 365 nm reflectance greater than 0.5 absorbance units.

7. An apparatus according to claim 6 wherein said felt comprises a base and a batt joined to said base, and wherein said batt comprises said portion of said felt having said L* color value less than L* 50.

8. An apparatus according to claim 7 wherein said base has an L* color value less than L* 40.

9. An apparatus according to claim 1 wherein said pattern layer does not penetrate said portion of said felt having said reflectance greater than 0.4 absorbance units.

10. An apparatus for removing water from paper during papermaking, said apparatus having an X–Y plane and a Z-direction orthogonal thereto, said apparatus comprising:

a papermaking felt layer, having mutually opposed surfaces, a machine facing surface and a paper facing surface, at least a portion of said felt having a 365 nm reflectance greater than about 0.4 absorbance units, said portion also having an average reflectance greater than about 0.4 absorbance units; and a pattern layer comprising a photosensitive resin and having mutually opposed surfaces, a felt facing surface and a paper facing surface, said pattern layer being joined to said felt at an interface between said felt facing surface of said pattern layer and said paper facing surface of said felt, and extending outwardly from said interface.

11. An apparatus according to claim 10 wherein said felt has an average reflectance greater than about 0.5 absorbance units.

12. An apparatus according to claim 10 wherein said felt has a 365 nm reflectance greater than about 0.5 absorbance units.

13. An apparatus for removing water from paper during papermaking, said apparatus having an X–Y plane and a Z-direction orthogonal thereto, said apparatus comprising:

a papermaking felt layer having mutually opposed surfaces, a machine facing surface and a paper facing surface, said papermaking felt comprising a batt of fibers joined to a base, a first portion of said fibers of said batt having a 365 nm reflectance greater than about 0.4 absorbance units, and a second portion of said fibers of said batt having a 365 nm reflectance less than about 0.4 absorbance units, said first and said second portions of said fibers being intermixed; and a pattern layer comprising a photosensitive resin and having mutually opposed surfaces, a felt facing surface and a paper facing surface, said pattern layer being joined to said felt at an interface between said felt facing surface of said pattern layer and said paper facing surface of said felt, and extending outwardly from said interface.

14. An apparatus according to claim 13 wherein said paper facing surface of said felt comprises fibers having a 365 nm reflectance less than about 0.4 absorbance units.

* * * * *

UNITED STATES PATENT AND TRADEMARK OFFICE

CERTIFICATE OF CORRECTION

PATENT NO. : 5,693,187

DATED : December 2,1997

INVENTOR(S) : ROBERT S. AMPULSKI ET AL.

It is certified that error appears in the above-identified patent and that said Letters Patent is hereby corrected as shown below:

Column 3, line 23, "base 15" should read – batt 15 --.

Column 10, line 9, "layer," should read – layer --.

Signed and Sealed this

Twenty-first Day of April, 1998

Bruce Lehman

*Attest:*

BRUCE LEHMAN

*Attesting Officer*

*Commissioner of Patents and Trademarks*